106-85 AU 118 EX
5/5/87 XR 4,662,897
106/85

United States Patent [19]

Atkinson et al.

[11] Patent Number: 4,662,897

[45] Date of Patent: May 5, 1987

[54] VITRIFIED COMPOSITE NOVACULITE AND PROCESS FOR PRODUCING SAME

[75] Inventors: Charles Atkinson, Howell, Mich.; Carl Moody, Little Rock, Ark.

[73] Assignee: Arkansas Hones Inc., Malvern, Ark.

[21] Appl. No.: 828,757

[22] Filed: Feb. 11, 1986

[51] Int. Cl.[4] ..... B24D 3/00

[52] U.S. Cl. ..... 51/293; 51/308; 51/309; 106/85

[58] Field of Search ..... 51/293, 308, 309; 106/85

[56] References Cited

U.S. PATENT DOCUMENTS

| | | | |
|---|---|---|---|
| 1,983,082 | 12/1934 | Howe et al. | 51/293 |
| 2,880,081 | 3/1959 | Eubank | 51/308 |
| 3,003,860 | 10/1961 | Sermon et al. | 51/308 |
| 3,092,476 | 6/1963 | Yatabe | 51/293 |
| 3,142,138 | 7/1964 | Kean et al. | 51/293 |
| 4,541,843 | 9/1985 | Elbel et al. | 51/293 |

*Primary Examiner*—Paul Lieberman
*Assistant Examiner*—Willie J. Thompson
*Attorney, Agent, or Firm*—Stephen D. Carver

[57] ABSTRACT

A process for artificially producing a relatively high density, vitrified composite novaculite product of relatively homogenous, characteristics with a MOH hardness of between 7.0 and 8.0, and the artificial stone product thereby produced. First a supply of dry abrasive comprising at least 95% by weight silicon dioxide is supplied. This source preferably includes mixtures of 100 mesh novaculite powder and 200 mesh novaculite powder. The dry abrasive mixture is thereafter mixed with a wetting agent, such as a 16:1 mixture of liquid organic concentrate and water, a temporary binder, calcium stearate, and a high refractory frit. The resultant mixture is thoroughly blended to form a first intermediate mixture having a weight of approximately 64% of said dry abrasive, 5.72% of a temporary binder, 3.08% of the wetting agent approximately 1.98% calcium stearate, and approximately 24.3% frit. The intermediate mixture is then subjected to gyratory screening yielding a second intermediate mixture which is then blended with a ball clay to provide a final mixture, which, after final screening, is suitable for cold pressing and subsequent vitrification. Preferably the final mixture consists of approximately 91.56% of the second intermediate mixture and 8.5% of the tennessee ball clay. The final mixture may be pressed in the shape of the desired end product at five tons per square inch. Vitrification is achieved by firing the pressed parts in an electric furnace up gentle ramps to slowly approach cone 04, and a soak time of approximately 2 hours is preferred.

31 Claims, 4 Drawing Figures

VITRIFIED COMPOSITE NOVACULITE AND PROCESS FOR PRODUCING SAME

BACKGROUND OF THE INVENTION

The present invention relates generally to the manufacture of sharpening stones. More particularly, the present invention relates to a process for artificially producing a high quality, high density abrasive novaculite product capable for use as a sharpening stone or the like.

As will be recognized by those skilled in the art, novaculite comprises a form of quartz which itself is primarily comprised of silicon dioxide. The mineral quartz is an oxide of the non metallic element silicon and it appears in a greater number of forms than any other mineral. Quartz is an essential constituent of many igneous rocks such as granite. In metamorphic rocks quartz constituent figures vary largely in the gneisses and in quarzite.

In its natural form novaculite has been mined, particularly in Arkansas, for use as a sharpening stone. It is increasingly becoming rate. Naturally occurring novaculite typically exhibits density of approximately 2.60 in molecular form, 2.3 in stone form and a MOH hardness of between 7–7.5, with natural stone of 7.5 MOH hardness being very rare. At the present rate of consumption in domestic cutting shops it is likely that presently known deposits of high grade novaculite will be consumed in the next thirty years. One reason for this is that conventional cutting processes inevitably waste approximately 75% of all quarried stone, in order to arrive at an end product stone which lacks flaws and which is suitable for honing. The rest will become seconds, or scrap. Already the translucent variety and Washita type are rare and very expensive whereas ten years ago these varieties constituted the bulk of Novaculite volume. There is now only one known commercial grade Washita deposit, and it is believed that it will expire within the next five to ten years.

A typical sharpening stone cut from naturally occurring, mined novaculite suffers from several imperfections. First, naturally occurring novaculite is not homogenous and regions of different density exist in the stone. Fissures such as quartz intrusions, cleavage or the like exist along certain fault lines which weaken the stone, and which indicate a region of differential density or sharpening characteristics. Natural stone may experience such deleterious fissure through natural processes when subject to freezing during the winter, and as a result most quarries must mine suitable novaculite at a substantial distance beneath the ground. This further aggravates the present shortage of high grade Novaculite. Other imperfections include sand pits, fault lines and quartz seams.

Naturally occurring novaculite stone suitable for cutting into sharpening stone also suffers from a plurality of various contaminating incursions. These are minor imperfections in the surface or the like such as sand pits which are formed when the stone is cut through and portions of sand naturally formed within the item being cut are exposed. Such sand pits continue to widen and enlarge as time goes on so that such a conventional finished stone product, when used as a sharpener, degrades.

Natural novaculite also exhibits substantial colour and density differences which effect the aesthetic value of the unit. Naturally occurring novaculite subject to the aforementioned difficulties may further interfere with normal knife sharpening. For example, if the stone consists of two substantially different density regions the softer or lower density region, characterized by a high coefficient of friction, will exhibit a grinding effect upon the knife being sharpened. However, the adjacent harder or higher density region will exhibit less friction, so as to be suited more for polishing the knife. Generally the uniformity of color of sample novaculite correlates to the uniformity of its density. Serious knife makers and knife sharpeners prefer a uniform density so that high standards of quality control can be maintained in the final knife blade or edge "polishing" stages of production.

Thus it would seem desirable to provide a system for artificially manufacturing novaculite exhibiting uniform characteristics, which does not include contaminant incursions, and which exhibits substantially homogenous density so as to consistently either "polish" or "grind" as desired by the user.

Moreover, it is desirable to produce such a stone with uniform color and without cleavage or fissures which shorten the life expectancy of prior art stones cut from naturally occurring novaculite deposits.

Of course it has previously been suggested in the prior art to artificially produce abrasive composite materials. Perhaps one of the earliest patents relating to this art is U.S. Pat. No. 1,983,082 issued to W. L. Howe on Dec. 4, 1934. The latter referece describes how raw materials of granular abrasive material may be formulated with a vitrified bond after a mixing process. The bond is matured after pressing and shaping by heating until vitrification occurs, at which point cementing of the various constituent grain occurs. Such a bond results in regions of voids, between which the "grinding" abrasive characteristics of the resultant stone are produced.

However, no process known to us has hitherto yielded artificial novaculite exhibiting superior qualities of homogeniety, uniform density, high strength (both tensile and abrasive), high MOH hardness in excess of MOH 7.0, and virtually complete omission of fissures, contaminating incursions and the like.

SUMMARY OF THE INVENTION

The present invention comprises a process for artificially producing a novaculite product of predictable, high quality characteristics which is quite superior to products made from natural or mined novaculite deposits.

The process contemplates the initial use of a source of silica to provide a supply of abrasive powder. In the best mode a ground novaculite powder, such as grade 100 mesh novaculite silica which is conventionally produced from naturally occurring novaculite and which is readily available to the relevant industrial market is employed.

A supply of dry abrasive comprising at least 95% by weight of silicon dioxide is first accumulated. This source of abrasive preferably consists of a mixture of approximately 70%–80% by weight of 100 mesh novaculite powder, and approximately 20% to 30% by weight of 200 mesh novaculite powder. Preferably this mixture is blended at room temperature of between approximately 65 to 80 degrees F.

The mixture of such dry abrasive is thereafter mixed with a wetting agent, water and a temporary binder, a quantity of calcium stearate and a high refractory frit. This resultant mixture is thoroughly blended to form a first intermediate mixture characterized by the following approximate constituent percentages (by weight): 64% of dry abrasive; 6% of the temporary binder; 3% of the wetting agent; approximately 2% calcium stearate, and approximately 25% frit.

The intermediate mixture is then subjected to gyratory screening whereby to break up particulates and aerate same to provide a second intermediate mixture which is then mixed with a ball clay to provide a final mixture, which, after final screening, is suitable for cold pressing and subsequent vitrification. Preferably the final mixture consists of approximately 91.5% of the second intermediate mixture and 8.5% of the Tennessee ball clay. Tennessee #1 Ball Clay from Kentucky and Tennessee clay company is appropriate.

It is believed that this use of clay and frit functions as a plasticizer to aid in achieving a high end product density at cold pressing pressures which would otherwise tend to crush silicon dioxide crystals.

After the mixture is so formed, it can be cold pressed at pressures up to five tons per square inch, without destruction of the novaculite crystal.

Vitrification is achieved by firing the pressed parts in an electric furnace up gentle ramps to slowly approach cone 04, and there a soak time of approximately 2 hours is preferred. The bond has been specifically formulated to vitrify at cone 04, "down hard".

The artificial stone produced though the aforesaid process, when compared to "naturally processed" prior art stones, has exhibited comparable tensile strength, superior durability, and improved controllability. While the finished product may not be harder than the hardness possible with naturally occurring but rare stone, it will resist scarring, flaking, and will exhibit a superior resistance to general wear and abrasion.

Therefore a basic object of the present invention is to produce a high quality artificial vitrified novaculite product.

A basic object of the present invention is to produce a high quality artificial vitrified novaculite product with more voids per volume.

Another object of the basic invention is to provide a vitrified novaculite product which exhibits greater wear resistance to mechanical friction loading than natural novaculite products.

A still further object is to provide a process for manufacturing vitrified novaculite suitable for use in sharpening hones and stones, which product exhibits superior surface characteristics and hence resists scoring and subsequent wear.

A similar object is to produce an artificially vitrified novaculite product suitable for use in sharpening stones which is substantially of a homogenous density and uniform color.

A related object is to provide a process for artificially producing novaculite products which lack contaminating incursions such as sand pits, fault lines, freeze lines, quartz seams, weakening fissures, cleavage lines or the like.

A fundamental object is to provide an economically sound process for artificially producing novaculite products.

A still further object of the present invention is to provide a product of the character described characterized by a high degree of aesthetic value.

Yet another object is to provide an artificial novaculite product of the character described which exhibits tensile strength at least equal with natural novaculite products.

Another fundamental object is to provide a process adapted to employ raw materials produced from naturally occurring abrasive novaculite (i.e. silica) which may be vitrified through a bonding process to form a new, similar novaculite product which is superior in sharpening features, durability and overall characteristics when compared to naturally quarried novaculite stone.

A still further object is to provide a procedure for cold compacting of granular silica which will result in tensile strength and wear characteristics superior to that of natural stone, and to do so without damaging the delicate silica crystal of the product during cold pressing.

Another fundamental object is to provide a process for forming an artificial novaculite product of the character described which assures the user of reasonable quality controls such that various batches of products produced with given parameters may be uniformly expected to produce virtually identical end products.

Of course a fundamental object is to provide an artificially produced sharpening stone which exhibits superior sharpening abilities when compared to quarried stone. It is a feature of the present invention that greater voids by volume are generated for better chip clearance and greater exposure of the individual cutting edges of the operative silicon granules.

A fundamental object of the present invention is to provide a process of the character described which may be used to bond several silica grain types exhibiting MOH hardnesses of between 7.0 and 7.5 as well as the group of garnets heretofore thought to be impossible to vitrify.

A fundamental object of the present invention is to provide a process for artificially producing a novaculite abrasive which is superior to naturally occurring stone whether used in dry sharpening, or with water lubrication or with oil lubrication. It is a feature of the present invention that the vitrified product exhibits greater wear resistance to mechanical loading than finished naturally occurring novaculite.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

Figure 1:
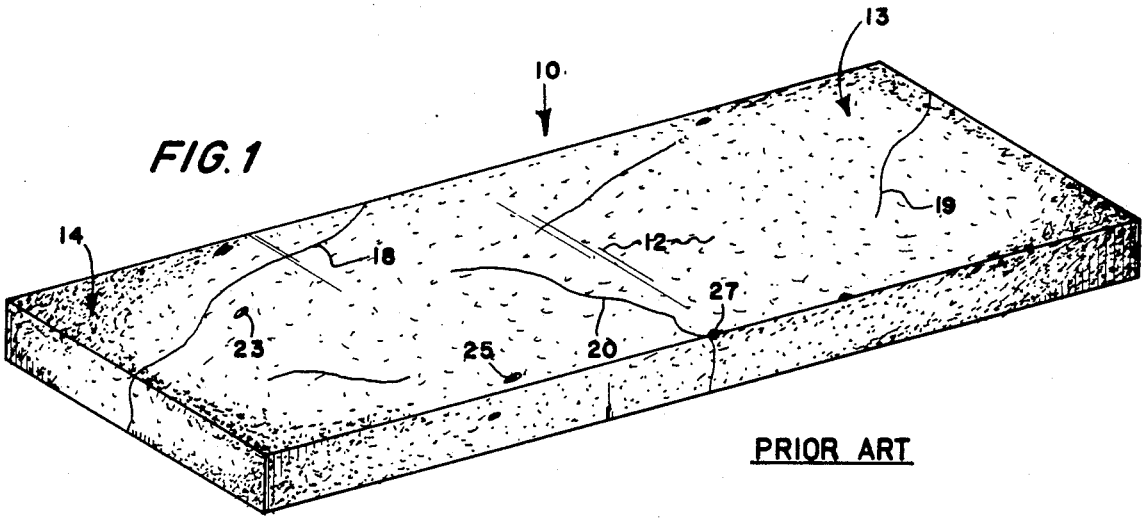
FIG. 1 is an isometric view of a prior art, previously existing naturally occurring sharpening hone formed by cutting naturally existing, mined novaculite, and exhibiting a plurality of conventional faults normally associated with such hones.

With initial reference now to the drawings, a generally rectangular conventional sharpening stone produced from naturally occurring novaculite has been generally indicated by the reference numeral 10. It will be noted from FIG. 1 that the upper surface 12 of the hone 10 varies in color, such that the color, for example, of portion 13 differs markedly from that the color of portion 14. Moreover, a plurality of fault lines or fissures 18, 19, and 20 exist.

Figure 3:
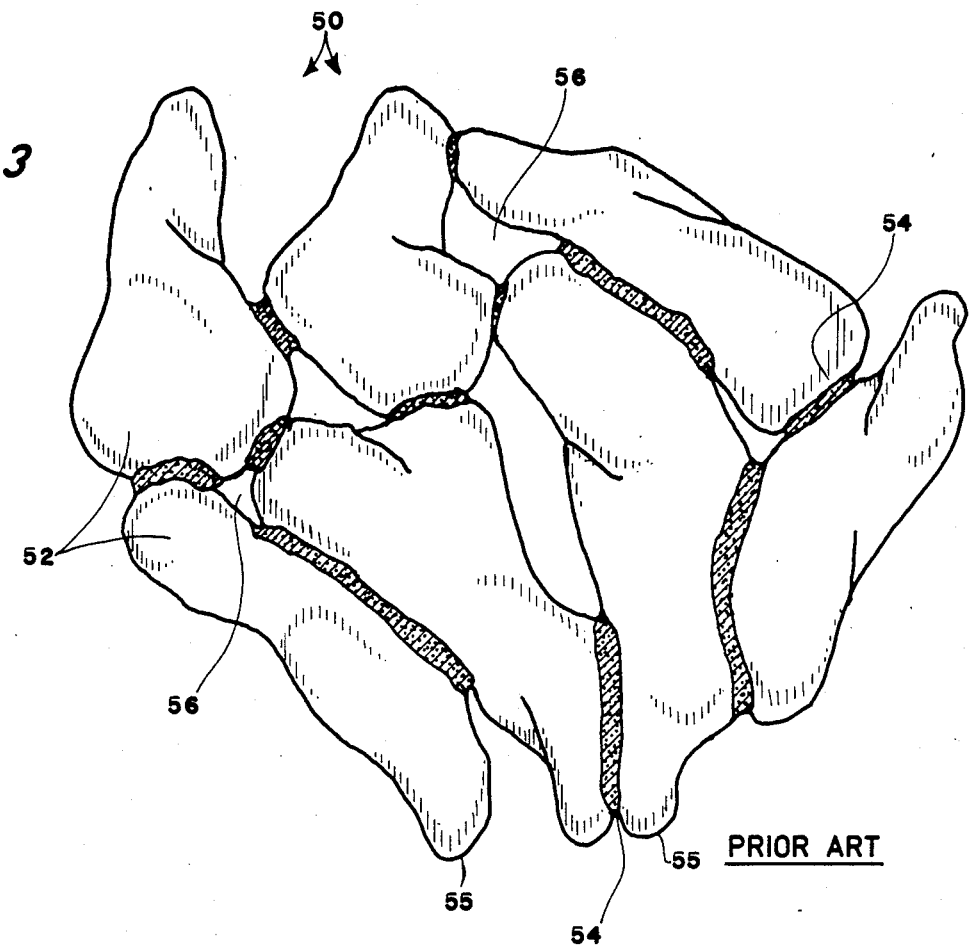
FIG. 3 is an enlarged pictorial illustration of natural novaculite illustrating the particular granules joined at their lateral surfaces and some of their points by the natural process of heat of fusion; and, FIG. 4 is an enlarged pictorial illustration of the vitrified stone product of the present invention wherein the granules are joined at the points and some of their lateral surfaces by posts (bond) of a matured glass matrix.
Figure 4:
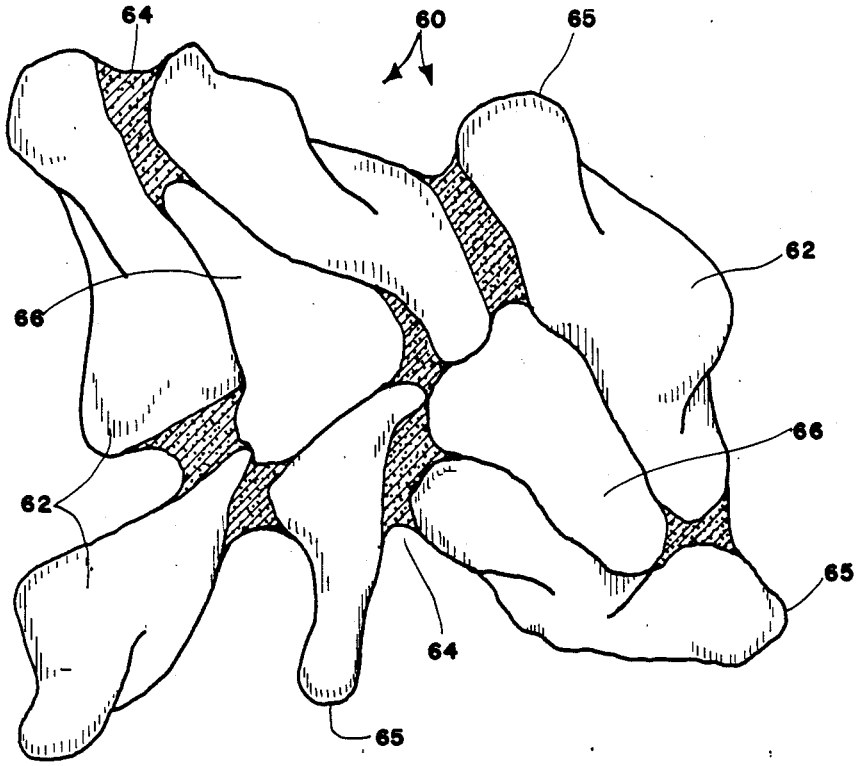
PRIOR ART FIG. 4

Fissure 20, for example, substantially weakens hone 10 and may lead to its actual breaking in half. Line 18 separates the various color regions of the stone, and in fact experience has demonstrated that the density and thus the sharpening characteristics of region 14 will be different from that of adjacent region 13. Surface 12 also includes a plurality of "sand pits" 23, 25, and 27 which are regions of small voids or "holes" inherent upon the surface. As will hereinafter be further described, FIG. 3 illustrates the microcrystalline composition of typical natural novaculite, such as that comprising hone 10. FIG. 4 illustrates the microcrystalline structure of the novaculite produced through the teachings of the present invention.

Such sand pits are found in naturally occurring novaculite after cutting of the quarried stone whereupon portions of nonvitrified silicon dioxide are freed and escape from the composite naturally occurring stone. Regions 23, 25, 27 may enlarge and become bigger as time goes on, and in fact, as sand pit 27 tends to enlarge it will eventually cooperate with fissure 20 to perhaps destroy the hone 10. As explained earlier, color differences of the naturally occurring product are an indicator of hardness, and a hard or high density portion of stone exhibits less friction, so as to be best employed for polishing. On the other hand the lower density or "course" or "soft" region exhibits a higher coefficient of friction so as to provide a grinding effect. The grinding effect may normally be used to put initial edges on dulled points and blades.

Figure 2:
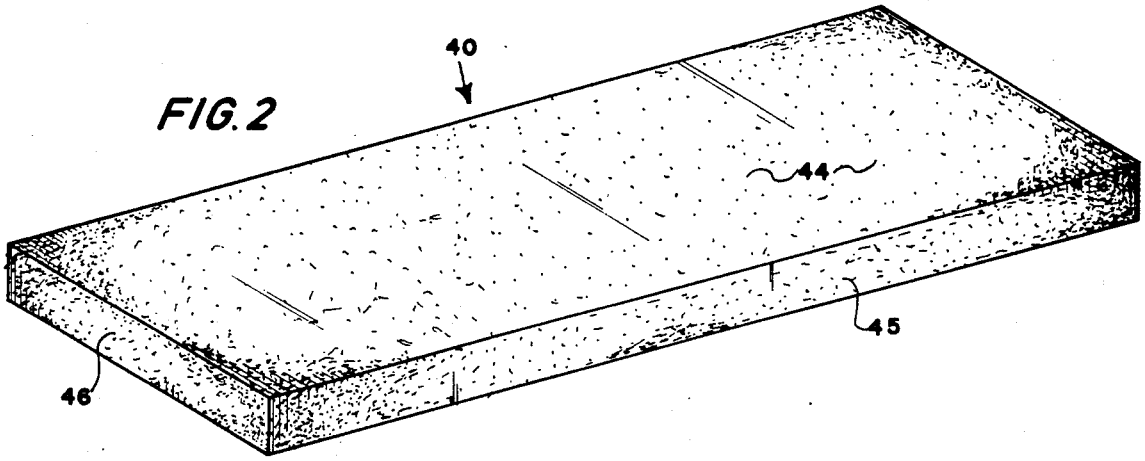
PRIOR ART FIG. 2
FIG. 2 is an isometric view of a sharpening hone produced from novaculite in accordance with the teachings of the present invention.

It will thus be apparent that as a knife if moved across the upper surface 12 of hone 10 it will be exposed to regions of both relatively hard and relatively soft abrasive regions. Hence, if polishing is desired some grinding effect will occur, and if grinding is desired grinding efficiency will be decreased by the fact that the higher density region is only capable of polishing. On the other hand, the hone 40 indicated in FIG. 2 has been produced by the process to be hereinafter described in detail. It exhibits substantially uniform and homogenous surface and coloration characteristics, and in fact it will be noted that no inperfections exist upon surface 44, or upon any of the edges 45, 46.

The process contemplates the selection of an initial raw silica powder for use and subsequent vitrification. A candidate powder could be any of the silicon dioxides of relatively low porosity which falls on the MOH scale between 7.0 and 7.5. In the best mode of the invention novaculite powder which is formed by grinding naturally occurring novaculite is employed to produce the composite product of the present invention. Preferably grade 100 Novacite-brand Novaculite powder is employed. This powder appears as a white granular powder, and it is substantially uniformly graded, and free of foreign matter contaminants. It is impervious to many acids and alkalies, in its loose granular form, and its true specific gravity at 70 degrees F., is approximately 2.66. Typical composition is as follows:

TABLE 1

| TYPICAL COMPOSITION OF RAW NOVACULITE POWDER (PERCENTS) | |
|---|---|
| Silica | 99.490 |
| Ferric Oxide | 0.039 |
| Aluminum Oxide | 0.102 |
| Titanium Oxide | 0.015 |
| Calcium Oxide | 0.333 |
| Magnesium Oxide | 0.021 |

Table 2 exhibits the screen analysis characteristics of the preferred novaculite powder:

TABLE 2

| SCREEN ANALYSIS |
|---|
| 100% through U.S. Standard Sieve Series #40 |
| 25% Maximum Retained on Control Sieve #100 |
| 50% Minimum Retained on Sieves #120, #140, and #200 |

Such a raw powder may be employed to produce a supply of dry abrasive initially adapted for employment in conjunction with the present process. The dry abrasive prefereed comprises a mixture of between 70% and 80% by weight of 100 mesh novaculite powder as aforedescribed, and approximately 20% to 30% by weight of 200 mesh novaculite powder.

The mixture of such dry abrasive is thereafter mixed with a wetting agent, such as a 16:1 mixture of water and liquid organic concentrate (Amway LOC); a temporary binder (such as acid treated dextrin); a supply of calcium stearate; and, lastly with a high refractory frit. A high borax frit with 62% silica and a fusion point of 1650 degrees F. is acceptable. Type 3GF frit produced by O. Hommel is preferred.

The latter resultant mixture is thoroughly blended to form a first intermediate mixture having a weight of approximately 62≈66% of said dry mixture having a weight of approximately 62–66% of said dry abrasive, 5–6% of the temporary binder, 2–4% of the wetting agent, approximately 1–2% calcium stearate, and approximately 22–25% frit. In the best mode of the invention the first intermediate mixture is characterized by a weight of approximately 64% of said dry abrasive, 5.72% of the temporary binder, 3.08% of the wetting agent, approximately 1.98% calcium stearate, and approximately 24.32% frit.

The first intermediate mixture is then subjected t gyratory screening whereby to break up particulates and aerate same to provide a second intermediate mixture which is then mixed with a ball clay to provide a final mixture. Tennessee #1 Ball Clay from Kentucky and Tennessee Clay Company is appropriate. Preferably the final mixture consists of approximately 91–93% of the second intermediate mixture and approximately 7–9% of Tennessee ball clay. In the best mode the final mixture consists of approximately 91.56% of the second intermediate mixture and 8.5% of Tennessee ball clay.

After final screening, the final mixture is suitable for cold pressing and subsequent vitrification. It is believed that this use of clay functions as a plasticizer to aid in achieving a high end product density at cold pressing pressures which would otherwise tend to crush silicon dioxide crystals. The percentage component parts of the final abrasive mixture prior to cold pressing are as follows:

TABLE 3

| Final Mixture DRY AND WET INGREDIENTS | APPROX. PERCENTAGE |
|---|---|
| 1. Dry novaculite abrasive powder 75% 100 mesh | 0.447 |
| 25% 200 mesh | 0.149 |
| 2. DRY powdered glass (Frit) Ground to 325 mesh (fusion point of 1650 degrees F. is desirable) | 0.221 |
| 3. Dry Tennessee Ball Clay (No. 1) | 0.086 |
| 4. Dry Calcium Stearate powder (very finely ground) | 0.018 |
| 5. Dry acid treated Dextrin powder 500 mesh | 0.052 |
| 6. Water mixed with liquid organic concentrate 16:1 | 0.028 |

The resultant final mixture may be shaped and/or pressed up to 5 tons per square inch, and it is believed that the use of clay added in the last step serves a dual role. First it is believed that the clay functions as a plasticizer to achieve relatively higher densities at pressures below that which would tend to crush the silica. Therefore we have added the clay last, contrary to the "normal" technique in abrasive manufacturing, to "float it" in the mix separately. Due to the high tonnages required to achieve our target densities the floating clay permits a more fluid movement of the granules under extreme pressure. Clay has hitherto been added earlier in the mixing process for green strength in the later cold pressing step, and as a result prior art vitrification may require up to cone 5 firing. In the prior art it has thus been more convenient to mix all components of the bond at once.

Vitrification is achieved by firing the pressed parts in an electric furnace up gentle ramps to slowly approach cone 04, and there a soak time of approximately 2 hours is preferred. The bond has been specifically formulated to vitrify at cone 04, "down hard". Softening occurs at about two thousand degrees F. depending upon the trace oxides and crystalline structure of the silica. Therefore it is essential to fire just under this point to avoid crystalline damage, and hence in the best mode a temperature of 1950 degrees F. is employed. The bonding agent is specially formulated to effectuate vitrification at Cone 04, and the gentle ramps prevent the subsequent generation of the above complained of fissures and contaminating incursions characteristic of naturally occurring novaculite. Additional soak tends to reduce the dimensional stability of the bond.

The stone produced through the aforesaid process has exhibited comparable tensile strength, superior durability, and improved controllability relative to naturally occurring novaculite. While the finished product may not be harder than the naturally occurring stone, it will resist scarring, flaking, and will exhibit a superior resistance to general wear and abrasion.

Also a large portion of the clay seems to support the whole body in some way as well approach the softening point of the silica. In other words, during vitrification the composite artificial product tends to remain more physically stable as cone 04 is approached during firing.

Calcium stearate is employed to produce the first intermediate mixture because it is believed to play a role as a plasticizer to improve overall densities which result at low pressure. Calcium stearate itself is a very powerful flux and without the pressure of very large amounts of clay the body would not have the very remarkable dimensional stability achieved through the aforementioned process. Thus through the process described we have accomplished high densities, high bond content, high tensile strength, and no destruction of the silica.

Preferably cold pressing is accomplished at five tons per square inch, in a Dieset universal type mold using the cavity fill process. After a trial at 5 tons per square inch the resultant density was 1.90 grams per cubic centimeter, considerably less than the natural density of 2.3 grams per cubic centimeter of normally occurring mined or quarried novaculite.

With reference now directed to FIGS. 3 and 4, a comparison of the natural microcrystalline structure with the microcrystalline structure of the artificial product of the present invention will reveal several important differences. A segment 50 of the natural rock includes a plurality of relatively tightly packed grains 52, which have lateral surfaces 54 which are fused together. Thus a plurality of mostly disconnected voids 56 exist. These voids typically comprise approximately four to ten percent by volume of the natural rock. The relatively closely spaced apart points 55 are responsible for the abrasive characteristics of the product.

The artificial segment 60 includes less compact grains 62 having extremes connected by common bond posts 64. The voids 66 thus tend to be relatively larger than voids 56, and the outer edges promote cutting since the points 65 are generally farther apart from one another than in the case of points 55. When points such as points 65 are spaced apart further, less work pressure is required when rubbing the abrasive with the item being sharpened. Sometimes points 55, for example, can occur so closely spaced that virtually no useful abrasive qualities will exist in such a stone.

The product produced by the aforesaid process thus results in a product of approximately 73% by weight (total solids) and therefore 27% voids by volume. This comparison of voids by volume constitutes proof that the artificial novaculite produced through the process described herein exhibits the previously stated characteristics and advantages.

From the foregoing, it will be seen that this invention is one well adapted to obtain all the ends and objects herein set forth, together with other advantages which are obvious and which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A process for producing a relatively high density vitrified composite stone product, the process comprising the steps of:

providing a supply of dry abrasive of at least 95% by weight silicon dioxide;

mixing said dry abrasive with a wetting agent and water, a temporary binder, calcium stearate, and a high refractory frit, whereby to form a first intermediate mixture, said first intermediate mixture having an approximate constituency, by weight, of 62%–66% of said dry abrasive, 5–6% of said temporary binder, 2–4% of the wetting agent, 1–2% calcium stearate, and 22–25% frit;

subjecting said first intermediate mixture to gyratory screening whereby to break up particulates and aerate same, thereby providing a second intermediate mixture of approximately the same chemical composition as said first intermediate mixture;

mixing said second intermediate mixture with ball clay to provide a final mixture, which after final screening, is suitable for cold pressure and subsequent vitrification, said final mixture characterized by the following approximate constituency by weight: 91–93% of said second intermediate mixture, and 7–9% by said ball clay;

cold pressing said final mixture into a desired shaped product; and, firing said shaped product.

2. The process as defined in claim 1 wherein said source of dry abrasive powder comprises a mixture of 70–80% by weight 100 mesh novaculite powder and approximately 20–30% by weight 200 mesh novaculite powder.

3. The process as defined in claim 1 wherein said first intermediate mixture comprises an approximate constituency, by weight, of 64% of said dry abrasive, 5.72% of said temporary binder, 3.08% of the wetting agent, 1.98% calcium stearate, and 24.3% frit.

4. The process as defined in claim 2 wherein said first intermediate mixture comprises an approximate constituency, by weight, of 64% of said dry abrasive, 5.72% of said temporary binder, 3.08% of the wetting agent, 1.98% calcium stearate, and 24.3% frit.

5. The process as defined in claim 3 wherein said final mixture is characterized by weight of 91.56% of said second intermediate mixture and 8.5% of said ball clay.

6. The process as defined in claim 4 wherein said final mixture is characterized by weight of 91.56% of said second intermediate mixture and 8.5% of said ball clay.

7. The process as defined in claim 1 wherein said glass bond is selected to vitrify at approximately cone 04, and said temporary bond disappears during firing.

8. The process as defined in claim 7 wherein firing said shaped product occurs with gentle ramps whereby cone 04 is slowly approached, and a soak time of approximately two hours at 1950 degrees F. is employed.

9. The process as defined in claim 1 wherein said firing occurs at a temperature of approximately 1950 degrees F.

10. The process as defined in claim 9 wherein said high refractory frit is approximately 325 mesh.

11. The process as defined in claim 10 wherein the wetting agent comprises a 16:1 mixture of water and liquid organic concentrate.

12. The process as defined in claim 11 wherein said frit comprises a high borax frit with 62% silica and a fusion point of 1650 degrees F.

13. The process as defined in claim 12 wherein the steps of cold pressing includes the step of raising forming pressures to approximately five tons per square inch.

14. The process as defined in claim 12 wherein said source of dry abrasive powder comprises a mixture of 70–80% by weight 100 mesh novaculite powder and approximately 20–30% by weight 200 mesh novaculite powder.

15. The process as defined in claim 14 wherein said first intermediate mixture comprises an approximate constituency, by weight, of 64% of said dry abrasive, 5.72% of said temporary binder, 3.08% of the wetting agent, 1.98% calcium stearate, and 24.3% frit.

16. The process as defined in claim 15 wherein said final mixture is characterized by weight of 91.56% of said second intermediate mixture and 8.5% of said ball clay.

17. A process for artificially producing a relatively high density vitrified composite novaculite end product, the process comprising the steps of:

providing a supply of dry abrasive of at least 95% by weight silicon dioxide, said source comprising a ixture of weight 100 mesh novaculite powder and weight 200 mesh novaculite powder;

mixing said dry abrasive with a wetting agent and water, a temporary binder, calcium stearate, and a high refractory frit, whereby to form a first intermediate mixture, said first intermediate mixture having an approximate constituency, by weight, of 62%–66% of said dry abrasive, 5–6% of said temporary binder, 2–4% of the wetting agent, 1–2% calcium stearate, and 22–25% frit;

subjecting said first intermediate mixture to gyratory screening whereby to break up particulates and aerate same, thereby providing a second intermediate mixture of approximately the same chemial composition as said first intermediate mixture;

mixing said second intermediate mixture with ball clay to provide a final mixture, which after final screening, is suitable for cold pressing and subsequent vitrification, said final mixture characterized by the following approximate constituency by weight: 92% of said second intermediate mixture, and 8% of said ball clay;

cold pressing said final mixture into a desired shape, and employing forming pressures of approximately five tons per square inch; and, firing with gentle ramps to slowly approach cone 04, and employing a soak of approximately two hours at 1950 degrees F.

18. The process as defined in claim 17 wherein:

said high refractory frit is approximately 325 mesh, and comprises a high borax frit with approximately 62% silica and a fusion point of approximately 1650 degrees F.; and, said wetting agent comprises a 16:1 mixture of water and liquid organic concentrate.

19. The process as defined in claim 17 wherein said first intermediate mixture is approximately characterized by weight, of 64% of said dry abrasive, 5.72% of said temporary binder, 3.08% of the wetting agent, 1.98% calcium stearate, and 24.3% frit.

20. The process as defined in claim 19 wherein said final mixture is approximately characterized by weight, of 91.56% of said second intermediate mixture, and 8.5% of said ball clay.

21. The process as defined in claim 20 wherein:

said high refractory frit is approximately 325 mesh, and comprises a high borax frit with approximately 62% silica and a fusion point of approximately 1650 degrees F.; and, said wetting agent comprises a 16:1 mixture of water and liquid organic concentrate.

22. An artificial, vitrified novaculite stone product formed by the process of:

providing a supply of dry abrasive of at least 95% by weight silicon dioxide, said source comprising a mixture of weight 100 mesh novaculite powder and weight 200 mesh novaculite powder;

mixing said dry abrasive with a wetting agent and water, a temporary binder, calcium stearate, and a high refractory frit, whereby to form a first intermediate mixture, said first intermediate mixture having an approximate constituency, by weight, of 62%–66% of said dry abrasive, 5–6% of said temporary binder, 2–4% of the wetting agent, 1–2% calcium stearate, and 22–25% frit;

subjecting said first intermediate mixture to gyratory screening whereby to break up particulates and aerate same, thereby providing a second intermediate mixture of approximately the same chemical composition as said first intermediate mixture;

mixing said second intermediate mixture with ball clay to provide a final mixture, which after final screening, is suitable for cold pressing and subsequent vitrification, said final mixture characterized by the following approximate constituency by weight: 92% of said second intermediate mixture, and 8% of said ball clay;

cold pressing said final mixture into a desired shape, and employing forming pressures of approximately five tons per square inch; and, firing with gentle ramps to slowly approach cone 04, and employing a soak of approximately two hours at 1950 degrees F.

23. The stone of claim 22 wherein said source of dry abrasive powder comprises a mixture of 70–80% by weight 100 mesh novaculite powder and approximately 20–30% by weight 200 mesh novaculite powder.

24. The stone of claim 22 wherein said first intermediate mixture comprises an approximate constituency, by weight, of 64% of said dry abrasive, 5.72% of said temporary binder, 3.08% of the wetting agent, 1.98% calcium stearate, and 24.3% frit.

25. The stone of claim 23 wherein said first intermediate mixture comprises an approximate constituency, by weight, of 64% of said dry abrasive, 5.72% of said temporary binder, 3.08% of the wetting agent, 1.98% calcium stearate, and 24.3% frit.

26. The stone of claim 25 wherein said final mixture is characterized by weight of 91.56% of said second intermediate mixture and 8.5% of said ball clay.

27. The stone of claim 26 wherein said glass bond is selected to vitrify at approximately cone 04, and said temporary bond disappears during firing.

28. The stone of claim 27 wherein firing thereof occurs with gentle ramp whereby cone 04 is slowly approached, and a soak time of approximately two hours at 1950 degrees F. is employed.

29. The stone of claim 28 wherein said high refractory frit is approximately 325 mesh.

30. The stone of claim 29 wherein the wetting agent comprises a 16:1 mixture of water and liquid organic concentrate.

31. The stone of claim 30 wherein said frit comprises a high borax frit with 62% silica and a fusion point of 1650 degrees F.

* * * * *